US009178306B2

(12) United States Patent
Shimizu et al.

(10) Patent No.: US 9,178,306 B2
(45) Date of Patent: Nov. 3, 2015

(54) LEVER-TYPE CONNECTOR

(75) Inventors: Tomohiko Shimizu, Shizuoka (JP); Akinori Tashiro, Shizuoka (JP); Akihiro Tsuruta, Shizuoka (JP); Kazuya Terao, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/128,660

(22) PCT Filed: Jun. 28, 2012

(86) PCT No.: PCT/JP2012/066554

§ 371 (c)(1),
(2), (4) Date: Dec. 23, 2013

(87) PCT Pub. No.: WO2013/005637

PCT Pub. Date: Jan. 10, 2013

(65) Prior Publication Data

US 2014/0148031 A1 May 29, 2014

(30) Foreign Application Priority Data

Jul. 1, 2011 (JP) ..... 2011-147155

(51) Int. Cl.
*H01R 13/629* (2006.01)
*H01R 13/74* (2006.01)
*H01R 13/639* (2006.01)

(52) U.S. Cl.
CPC .... *H01R 13/62977* (2013.01); *H01R 13/62955* (2013.01); *H01R 13/639* (2013.01); *H01R 13/743* (2013.01)

(58) Field of Classification Search
CPC ..... H01R 13/62; H01R 13/62933; H01R 13/62938; H01R 13/62955
USPC ..... 439/299, 153, 152, 160, 157, 296, 544
See application file for complete search history.

(56) References Cited

U.S. PATENT DOCUMENTS 6,648,659 B2 * 11/2003 Matsushita ..... 439/157
6,655,971 B2 * 12/2003 Maegawa ..... 439/157

(Continued)

FOREIGN PATENT DOCUMENTS

CN 101180773 A 5/2008
CN 101465500 A 6/2009

(Continued)

OTHER PUBLICATIONS

Korean office action letter issued on Nov. 26, 2014 in the counterpart Korean patent application.

(Continued)

*Primary Examiner* — Amy Cohen Johnson
*Assistant Examiner* — Oscar C Jimenez
(74) *Attorney, Agent, or Firm* — Marvin A. Motsenbocker; Mots Law, PLLC

(57) ABSTRACT

A lever-type connector includes a first connector, a second connector, and a lever that rotates to fit the first connector and the second connector together, the first connector and the second connector being mounted into a mounting hole of a panel when the first and second connectors are in a fitted state. The lever includes a flexible locking portion. The first connector includes a locked portion with which the locking portion is engaged in a manner such that the lever rotates to bend the locking portion when the first and second connectors are properly fitted together. The locking portion includes a regulating portion positioned to face an edge portion of the mounting hole of the panel when the first connector and the second connector properly fitted together are mounted in the mounting hole so as to prevent the engagement between the locking portion and the locked portion from being released.

3 Claims, 5 Drawing Sheets

(56) References Cited

U.S. PATENT DOCUMENTS

| | | | | |
|---|---|---|---|---|
| 7,513,784 | B2 * | 4/2009 | Shibata | 439/157 |
| 2002/0178538 | A1 | 12/2002 | Matsushita | |

FOREIGN PATENT DOCUMENTS

| | | | | | |
|---|---|---|---|---|---|
| JP | 2002-359029 | A | | 12/2002 | |
| JP | 2002-359037 | A | | 12/2002 | |
| JP | 2002359037 | A | * | 12/2002 | H01R 13/74 |
| JP | 2003-282183 | A | | 10/2003 | |
| JP | 2008-027787 | A | | 2/2008 | |
| JP | 2009-135071 | A | | 6/2009 | |
| JP | 2011-081951 | A | | 4/2011 | |

OTHER PUBLICATIONS

Japanese office action letter issued on Jan. 20, 2015 in the counterpart Japanese patent application.

Korean office action letter issued on Apr. 28, 2015 in the counterpart Korean patent application.

Chinese office action letter issued on May 25, 2015 in the counterpart Chinese patent application.

The Korean office action letter issued on Aug. 18, 2015 in the counterpart Korean patent application.

* cited by examiner

LEVER-TYPE CONNECTOR

TECHNICAL FIELD

The present invention relates to a lever-type connector attached to a panel.

BACKGROUND ART

There are known lever-type connectors attached to a panel, the connectors each including a male connector housing as a first connector, a female connector housing as a second connector fittable into the male connector housing, and a lever that is provided with the male connector housing and rotates to fit the male connector housing and the female connector housing together, wherein the male connector housing and the female connector housing fitted together are mounted into a mounting hole of the panel (for example, PTL 1).

In such a lever-type connector, the lever has a guide formed substantially in front of the lever, wherein the guide is oblique to the mounting direction of the connector into the mounting hole and is brought into contact with an edge of the mounting hole when the lever is in a fitting position. In addition, a rear surface of the female connector housing is substantially flush with or in front of the guide when the lever is in a standby position and when the female connector housing is fitted in the male connector housing.

This configuration allows the guide to properly guide the lever-type connector into the mounting hole of the panel even if the lever-type connector is in an offset position from the mounting hole since the guide of the lever comes into contact with the edge of the mounting hole. Further, since the rear surface of the female connector housing is substantially flush with or in front of the guide when the lever is in the standby position, the user can push the rear surface of the female connector housing without interference of the guide.

CITATION LIST

Patent Literature

PTL1: JP 2002-359029 A

SUMMARY OF INVENTION

However, in such a lever-type connector, the user can still operate the lever when the first connector and the second connector properly fitted together are mounted into the mounting hole of the panel since the rotation of the lever is not prevented. As a result, the fitted state of the first connector and the second connector may be released.

The present invention has been accomplished in view of the above-described conventional problem. An object of the present invention is to provide a lever-type connector capable of preventing a fitted state between connectors attached to a panel from being released.

In order to solve the above-described problem, an aspect of the present invention is to provide a lever-type connector including: a first connector; a second connector finable into the first connector; and a lever that is provided with one of the first connector and the second connector and rotates to fit the first connector and the second connector together, the first connector and the second connector being mounted into a mounting hole of a panel when the first connector and the second connector are in a fitted state, wherein the lever includes a flexible locking portion, and the one of the first connector and the second connector includes a locked portion with which the locking portion is engaged in a manner such that the lever rotates to bend the locking portion when the first connector and the second connector are properly fitted together, and the locking portion includes a regulating portion positioned to face an edge portion of the mounting hole of the panel when the first connector and the second connector properly fitted together are mounted in the mounting hole so as to prevent an engagement between the locking portion and the locked portion from being released.

The lever-type connector includes the regulating portion as described above. Therefore, the rotation of the lever is prevented in the state where the lever-type connector is mounted in the panel since the regulating portion prevents the engagement between the locking portion and the locked portion from being released.

Accordingly, the fitted state between the connectors attached to the panel can be prevented from being released since the rotation of the lever is prevented when the lever-type connector is mounted in the panel.

In order to solve the above-described problem, another aspect of the present invention is to provide the lever-type connector, wherein the locking portion includes a flexible panel locking portion that is bent by the edge portion of the mounting hole when inserted into the mounting hole of the panel and is locked with the edge portion of the mounting hole when the regulating portion is positioned to face the edge portion of the mounting hole so as to prevent the one of the connectors from coming off the panel.

This type of the lever-type connector includes the panel locking portion as described above. Therefore, the properly fitted state between the connectors can be kept and the lever-type connector can be held in the panel by use of only one locking portion.

In order to solve the above-described problem, still another aspect of the present invention is to provide the lever-type connector, wherein a width of the one of the connectors is substantially the same as that of the mounting hole of the panel, the one of the connectors is provided with a plurality of panel lock projections on both side surfaces in a width direction that are locked with the edge portion of the mounting hole when mounted into the mounting hole so as to prevent the one of the connectors from coming off the panel, and the locking portion is located on a gravity-affecting side of the one of the connectors when the first connector and the second connector are properly fitted together.

This type of the lever-type connector includes the plurality of panel lock projections as described above. Therefore, the lever-type connector is not inclined in the mounting hole of the panel so as to prevent the locked state of the locking portion or the panel lock projections from being released by the inclination of the lever-type connector.

Further, the locking portion is located on the gravity-affecting side of the one of the connectors when the first connector and the second connector are properly fitted together. Therefore, even if some of the panel lock projections are damaged, the engagement between the locking portion and the locked portion is not released since the regulating portion is in contact with the edge portion of the mounting hole, thereby keeping the normally fitted state between the connectors.

As described above, the present invention can provide a lever-type connector capable of preventing the fitted state between the connectors attached to the panel from being released.

DESCRIPTION OF EMBODIMENTS

Figure 1:
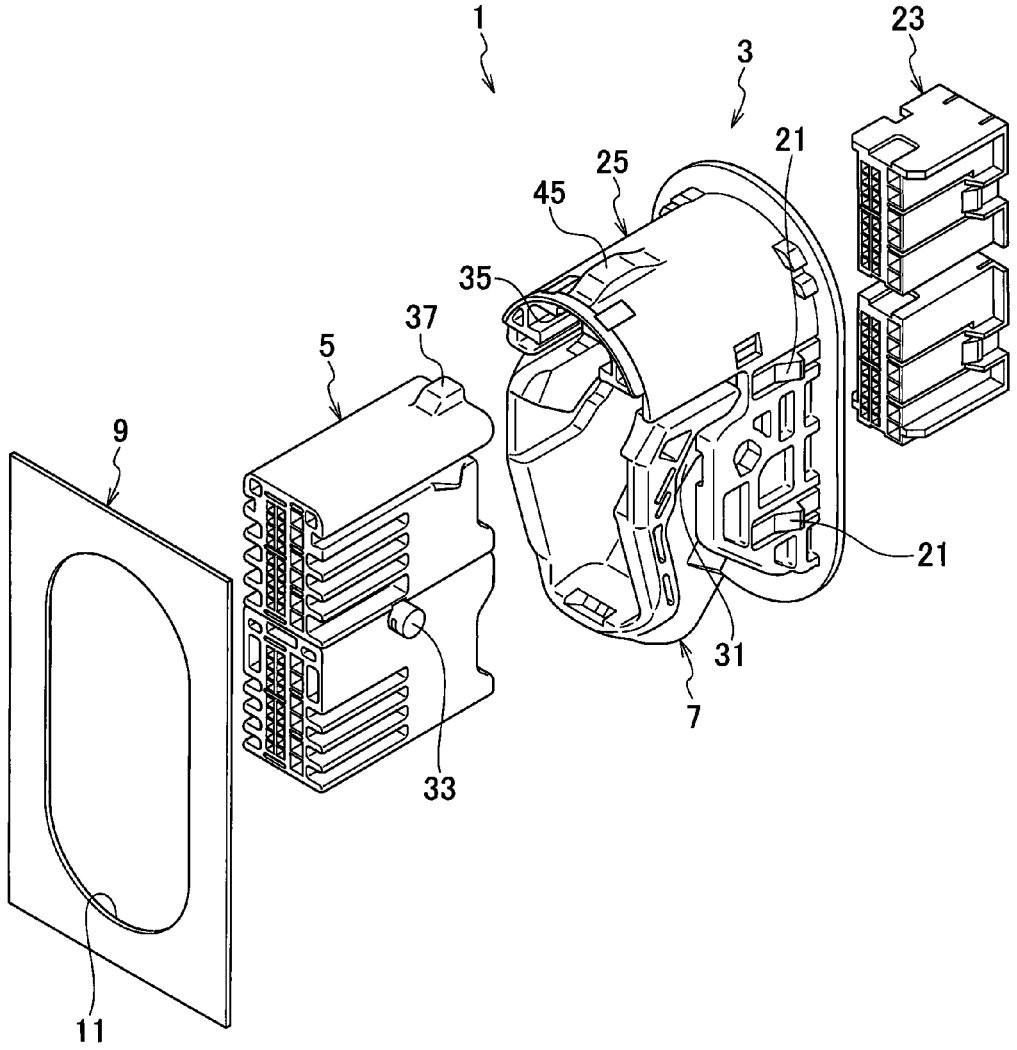
FIG. 1 is an exploded perspective view of a lever-type connector according to an embodiment of the present invention.
Figure 2:
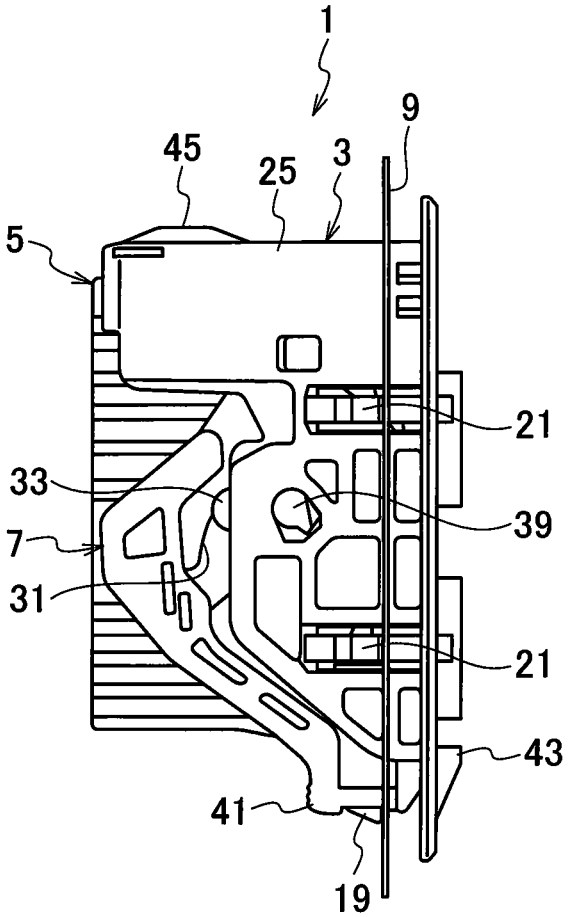
FIG. 2 is a side view of the lever-type connector according to the embodiment of the present invention.
Figure 3:
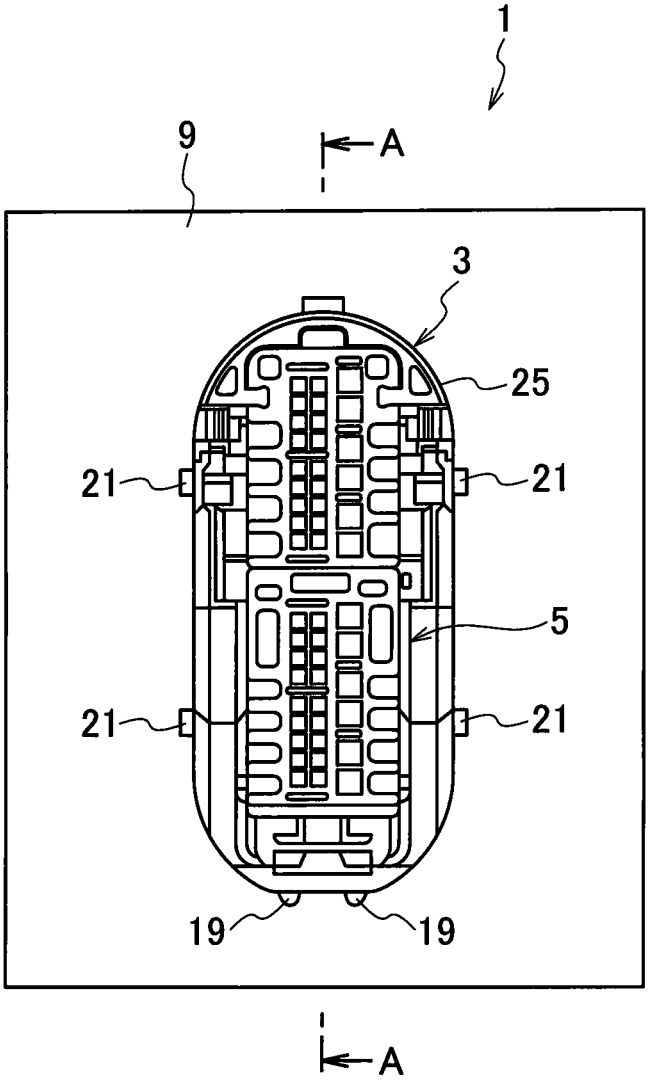
FIG. 3 is a front view of the lever-type connector according to the embodiment of the present invention.
Figure 4:
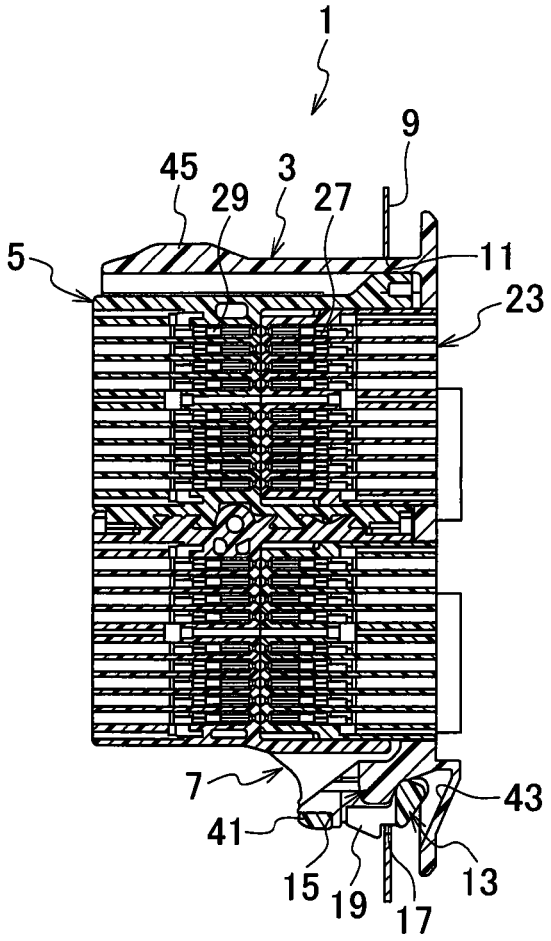
FIG. 4 is a cross-sectional view along the line A-A in FIG. 3.
Figure 5:
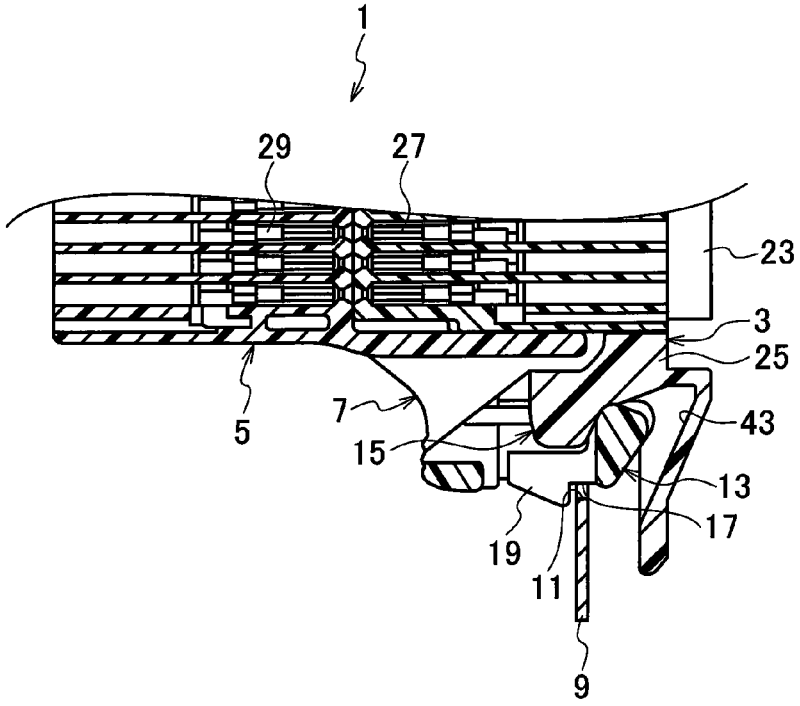
FIG. 5 is an enlarged view illustrating a main part of the lever-type connector according to the embodiment of the present invention.

Hereinafter, a lever-type connector according to an embodiment of the present invention will be explained with reference to FIGS. 1 to 5.

A lever-type connector 1 according to the present embodiment includes a first connector 3, a second connector 5 fittable into the first connector 3, and a lever 7 that is provided with the first connector 3 and rotates to fit the first connector 3 and the second connector 5 together. The first connector 1 and the second connector 3 fitted together are mounted into a mounting hole 11 of a panel 9.

The lever 7 includes a flexible locking portion 13, and the first connector 3 includes a locked portion 15 with which the locking portion 13 is engaged in a manner such that the lever 7 rotates to bend the locking portion 13 when the first connector 1 and the second connector 5 are properly fitted together.

The locking portion 13 is provided with a regulating portion 17 positioned to face an edge portion of the mounting hole 11 when the first connector 3 and the second connector 5 properly fitted together are mounted into the mounting hole 11, thereby preventing the engagement between the locking portion 13 and the locked portion 15 from being released.

The locking portion 13 is further provided with flexible panel locking portions 19 that are bent by the edge portion of the mounting hole 11 of the panel 9 when being inserted into the mounting hole 11 and are locked with the edge portion of the mounting hole 11 when the regulating portion 17 is positioned to face the edge portion of the mounting hole 11, thereby preventing the first connector 3 from coming off the panel 9.

The width of the first connector 3 is substantially the same as that of the mounting hole 11 of the panel 9. The first connector 3 is provided, on both side surfaces in the width direction, with a plurality of panel lock projections 21 that are locked with the edge portion of the mounting hole 11 when the first connector 3 is mounted into the mounting hole 11, thereby preventing the first connector 3 from coming off the panel 9. The locking portion 13 is located on the gravity-affecting side of the first connector 3 when the first connector 3 and the second connector 5 are properly fitted together.

As illustrated in FIGS. 1 to 5, the first connector 3 includes an inner housing 23 and a frame 25. The inner housing 23 has a structure in which two casing members are stacked on top of each other in the vertical direction, and the inner housing 23 houses a plurality of terminals 27 inside thereof. The inner housing 23 is housed in the frame 25.

The frame 25 is formed into a cylindrical shape and houses the inner housing 23 inside thereof. The width of the frame 25 is substantially the same as that of the mounting hole 11 of the panel 9. The frame 25 is provided, on both side surfaces in the width direction, with a plurality (four in the embodiment) of panel lock projections 21 each in an elastically deformable manner. The panel lock projections 21 are locked with the edge portion of the mounting hole 11 of the panel 9 when mounted into the mounting hole 11, so as to prevent the first connector 3, namely, the lever-type connector 1 from coming off the panel 9. The inner housing 23 housed in the frame 25 is fitted to the second connector 5 in the frame 25.

The second connector 5 has a structure in which two casing members larger than those of the inner housing 23 are stacked on top of each other in the vertical direction, and houses therein a plurality of mating terminals 29 connected to the terminals 27. The second connector 5 is provided with cam followers 33 protruding from both side surfaces of the second connector 5 and inserted into cam grooves 31 of the lever 7. The second connector 5 is also provided, on the upper surface thereof, with a guide projection 37 engaged with a guide groove 35 formed on the frame 25. The terminals 27 are connected to the mating terminals 29 in a manner such that the guide projection 37 is inserted in the guide groove 35 and the cam followers 33 are inserted in the cam grooves 31 so that the inner housing 23 and the second connector 5 are fitted together by the rotation of the lever 7.

The lever 7 is rotatably attached to the frame 25 with axial supports 39 provided on both side surfaces of the lever 7. When the cam followers 33 of the second connector 5 are inserted in the cam grooves 31, that is, when the first connector 3 and the second connector 5 are in a temporally fitted state, the lever 7 rotates by pressing an operating portion 41 so that the first connector 3 and the second connector 5 are properly fitted together. The lever 7 has the locking portion 13 with which the locked portion 15 of the frame 25 is engaged.

The locking portion 13 is flexibly provided at an end portion of the lever 7 on the operating portion 41 side. The locking portion 13 comes into contact with the locked portion 15 when the rotating operation of the lever 7 reaches the final phase, in other words, when the first connector 3 and the second connector 5 come closer to the properly fitted state. The locking portion 13 is then engaged with the locked portion 15 when the rotating operation of the lever 7 ends, that is, when the first connector 3 and the second connector 5 are properly fitted together.

The locked portion 15 is provided on and projects from the lower surface of the frame 25, and is provided with an inclined surface downwardly inclined from the top towards both sides. The locked portion 15 bends the locking portion 13 outward when the locking portion 13 is brought into contact with the locked portion 15 by the rotating operation of the lever 7. By further continuing the rotating operation of the lever 7 from this state, the locking portion 13 returns inward across the locked portion 15 so that the locked portion 15 is engaged with the locking portion 13. The engagement between the locking portion 13 and the locked portion 15 keeps the properly fitted state between the first connector 3 and the second connector 5.

The locking portion 13 is located on the gravity-affecting side of the first connector 3 when the first connector 3 and the second connector 5 are properly fitted together, and the locking portion 13 is provided with the regulating portion 17 and the panel locking portions 19. The regulating portion 17 is formed on the outer surface side of the locking portion 13. The regulating portion 17 is positioned to face the lower edge portion of the mounting hole 11 when the first connector 3 and the second connector 5 properly fitted together are mounted into the mounting hole 11. This prevents the lever 7 from rotating even when the locking portion 13 is likely to bend outward since the regulating portion 17 is in contact with the lower edge of the mounting hole 11 so as to prevent the engagement between the locking portion 13 and the locked portion 15 from being released. The prevention of the rotation of the lever 7 can prevent the fitted state between the first connector 3 and the second connector 5 from being released.

When the locking portion 13 and the locked portion 15 are in the engaged state, the locking portion 13 is positioned inside an operation regulating portion 43 provided in the frame 25. The operation regulating portion 43 is provided in the frame 25 to cover the periphery of the locking portion 13 so as to prevent the locking portion 13 from bending outward by an unexpected force or the like.

The panel locking portions 19 are provided on the front side of the regulating portion 17 in the mounting direction of the lever-type connector 1 to the panel 9. The panel locking portions 19 are flexibly provided on and project from both sides of the regulating portion 17 in the width direction and each provided with an inclined surface on the outer side. The panel locking portions 19 are bent inward by the lower edge portion of the mounting hole 11 when the first connector 3 and the second connector 5 properly fitted together are mounted into the mounting hole 11 of the panel 9. By further inserting the lever-type connector 1 into the mounting hole 11 of the panel 9, the panel locking portions 19 return outward across the lower edge of the mounting hole 11 so that the panel locking portions 19 are locked with the edge portion of the mounting hole 11. Such panel locking portions 19 prevent the lever-type connector 1 from coming off the panel 9 in association with the panel lock projections 21 of the frame 25.

The frame 25 is provided with a detecting portion 45 protruding from the upper surface of the frame 25. The detecting portion 45 is a detection means that prevents the lever-type connector 1 from being mounted into the panel 9 when the first connector 3 and the second connector 5 are not in the properly fitted state but in a partially fitted state. In particular, for example, in the state where the locking portion 13 is not completely engaged with the locked portion 15 and is located on the top of the locked portion 15, the outer surface of the locking portion 13 interferes with the lower edge portion of the mounting hole 11 when the lever-type connector 1 is being mounted in the panel 9. Then, the lever-type connector 1 is moved upward in the mounting hole 11, so that the detecting portion 45 also interferes with the upper edge portion of the mounting hole 11. Due to these interfering, the partially fitted state between the first connector 3 and the second connector 5 can be detected.

In the lever-type connector 1 described above, the locking portion 13 is provided with the regulating portion 17 positioned to face the edge portion of the mounting hole 11 when the first connector 3 and the second connector 5 properly fitted together are mounted into the mounting hole 11 so as to prevent the engagement between the locking portion 13 and the locked portion 15 from being released. Therefore, the rotation of the lever 7 is prevented since the engagement between the locking portion 13 and the locked portion 15 is prevented from being released when the lever-type connector 1 is mounted in the panel 9.

Accordingly, the fitted state between the connectors 3 and 5 attached to the panel 9 can be prevented from being released since the rotation of the lever 7 is prevented when the lever-type connector 1 is mounted in the panel 9.

Further, the locking portion 13 is provided with the panel locking portions 19 that are locked with the edge portion of the mounting hole 11 when the regulating portion 17 is positioned to face the edge portion of the mounting hole 11 so as to prevent the first connector 3 from coming off the panel 9. Therefore, the properly fitted state between the connectors 3 and 5 can be kept and the lever-type connector 1 can be held in the panel 9 by use of only one locking portion 13.

Further, the width of the first connector 3 is substantially the same as that of the mounting hole 11 of the panel 9, and the first connector 3 is provided with the panel lock projections 21 on both side surfaces in the width direction that are locked with the edge portion of the mounting hole 11 when the first connector 3 is mounted into the mounting hole 11, thereby preventing the first connector 13 from coming off the panel 9. Accordingly, the lever-type connector 1 is not inclined in the mounting hole 11 of the panel 9 so as to prevent the locked state of the locking portion 13 or the panel lock projections 21 from being released by the inclination of the lever-type connector 1.

Further, the locking portion 13 is located on the gravity-affecting side of the first connector 3 when the first connector 3 and the second connector 5 are properly fitted together. Therefore, even if any panel lock projection 21 is damaged, the engagement between the locking portion 13 and the locked portion 15 is not released since the regulating portion 17 is in contact with the edge portion of the mounting hole 11 so as to keep the properly fitted state between the connectors 3 and 5. In addition, since the locked state of the panel locking portions 19 with the edge portion of the mounting hole 11 is not released, the lever-type connector 1 can be held in the panel 9.

Although the lever-type connector according to the embodiment of the present invention has a configuration in which the lever is provided with the first connector, the lever-type connector may have a configuration in which the lever is provided with the second connector.

Although the first connector includes the inner housing and the frame that are formed separately and assembled together, the inner housing and the frame may be integrated into the first connector.

Although the locking portion is located on the gravity-affecting side of one of the first connector and the second connector when these connectors are properly fitted together, the locking portion may be located on the opposite side of the gravity-affecting side of one of the connectors. In such a case, the regulating portion may be provided to face the upper edge portion of the mounting hole of the panel. Such a regulating portion can also prevent the engagement between the locking portion and the locked portion from being released.

The invention claimed is:

1. A lever-type connector comprising:

a first connector;

a second connector fittable into the first connector; and a lever on either the first connector or the second connector, for being turned to cause the first connector and the second connector to fit together, the first connector and the second connector in the fitted-together state being mountable into a mounting hole in a panel; wherein the lever includes a bendable engager portion, and whichever of the first connector and the second connector that does not have the lever includes an engaged portion with which the bendable engager portion interlocks by the lever being rotated to bend the bendable engager portion, with the first connector and the second connector properly fitted together, and the bendable engager portion includes a restricting portion disposed for opposing an edge portion of the panel mounting hole when the first connector and the second connector, properly fitted together such that the engager portion is interlocked with the engaged portion, are mounted in the mounting hole, and of form such as, in position opposing the panel mounting-hole edge, to prevent the interlocking of the engager portion and the engaged portion from coming undone.

2. The lever-type connector according to claim 1, wherein the bendable engager portion includes a bendable panel-interlocking portion configured such as to be bent by the edge portion of the mounting hole when the bendable engager portion is inserted through the mounting hole in the panel, wherein with the restricting portion disposed opposing the edge portion of the mounting hole, the panel-interlocking portion locks onto the mounting-hole edge portion, preventing the lever-less connector from coming off the panel.

3. The lever-type connector according to claim 1, wherein:

the lever-less connector is dimensioned widthwise to substantially match the panel mounting hole widthwise;

the lever-less connector is provided, on either of widthwise side surfaces thereof, with a plurality of panel-lock projections for interlocking with the edge portion of the mounting hole when the first connector and the second connector in the fitted-together state are mounted into the mounting hole, so as to prevent the lever-less connector from coming off the panel; and bendable engager portion, in a state in which the first connector and the second connector are properly fitted together, is situated in the lever-less connector's gravitational direction.

* * * * *